US008430490B2

(12) United States Patent
Morita

(10) Patent No.: US 8,430,490 B2
(45) Date of Patent: Apr. 30, 2013

(54) INK JET PRINTING APPARATUS

(75) Inventor: Osamu Morita, Yokosuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 304 days.

(21) Appl. No.: 12/419,091

(22) Filed: Apr. 6, 2009

(65) Prior Publication Data

US 2009/0262150 A1 Oct. 22, 2009

(30) Foreign Application Priority Data

Apr. 21, 2008 (JP) ..... 2008-110334

(51) Int. Cl.
*B41J 2/19* (2006.01)
*B41J 2/175* (2006.01)
*B41J 2/17* (2006.01)

(52) U.S. Cl.
USPC ..... 347/92; 347/5; 347/7; 347/84; 347/85; 347/93

(58) Field of Classification Search ..... 347/92, 347/93
See application file for complete search history.

(56) References Cited

U.S. PATENT DOCUMENTS 6,079,808 A * 6/2000 Yamaguchi ..... 347/30
6,293,663 B1 9/2001 Koshikawa et al. ..... 347/86
6,315,402 B1 * 11/2001 Kawase ..... 347/85
6,338,552 B1 1/2002 Sato et al. ..... 347/85
7,607,770 B2 * 10/2009 Inoue et al. ..... 347/85
7,841,706 B2 * 11/2010 Ishinaga et al. ..... 347/84
2001/0020970 A1 * 9/2001 Kuribayashi et al. ..... 347/85
2003/0007048 A1 * 1/2003 Otsuka et al. ..... 347/89
2004/0061748 A1 * 4/2004 Kuwabara et al. ..... 347/85
2006/0268078 A1 * 11/2006 Kumagai ..... 347/85
2008/0238979 A1 * 10/2008 Umeda ..... 347/17

FOREIGN PATENT DOCUMENTS

JP 2003-159813 A 6/2003
JP 2006-188008 A 7/2006

* cited by examiner

*Primary Examiner* — Ryan Lepisto
(74) *Attorney, Agent, or Firm* — Fitzpatrick, Cella, Harper & Scinto

(57) ABSTRACT

An air pump is driven to supply air via an air supply tube to a sub tank, by which a predetermined quantity of the air is mixed inside the sub tank via a gas-liquid separation membrane. Next, a carriage is swayed to agitate the ink by using the air mixed inside the sub tank. Then, the air pump is driven to discharge the air inside the sub tank via the gas-liquid separation membrane. In the above-described agitating motions, since the air utilized for the agitation is discharged from an ink tank after agitation processing, it is possible to prevent the air from remaining inside the ink tank to inflate, thereby adversely influencing the pressure relationship with a printing head.

9 Claims, 13 Drawing Sheets

INK JET PRINTING APPARATUS

BACKGROUND OF THE INVENTION

1. Field of the Invention

The present invention relates to an ink jet printing apparatus and more particularly to a constitution for agitating an ink inside an ink tank.

2. Description of the Related Art

An inkjet printer, which is a typical inkjet printing apparatus, ejects an ink on a printing medium such as printing sheets to print images and characters. Among apparatuses of this type, a printer handling larger-sized printing sheets such as A0-size sheets and a professional-use printer for relatively large quantities of printing require a large-capacity ink tank in accordance with relatively large ink consumption. Further, a multi-color printer using various types of inks requires many tanks which accommodate inks according to the number of colors thereof. The above-described printers greater in ink consumption are often provided with an ink supply source such as an ink tank at a predetermined position thereof due to the fact that it is inconvenient to move a great-capacity ink tank mounted on a carriage together with a printing head. Therefore, a constitution has been adopted in which an ink is temporarily supplied from the ink supply source via a tube to a sub tank on the carriage and then supplied from the sub tank to the printing head. The sub tank of the above constitution is used to absorb a variation in pressure of the ink in line with movement of the carriage, so as to stabilize supply of the ink to the printing head.

On the other hand, as an ink used for printers, an ink in which a pigment is dispersed (herein after, referred to as a pigment ink) has been known. The pigment ink contains pigments as a coloring agent and in which the pigment is dispersed into an ink solvent. The pigment ink has an advantage that color develops vividly but has a fundamental disadvantage that when it is allowed to stand for a long period of time, for example, over about one to two months, the pigment settles out. When the pigment settles out as described above, an ink inside the sub tank is made thin at the upper part of the tank and made thick at the lower part of the tank, which results in unevenness in concentrations of the pigment. Then, this unevenness in concentrations will provide such a problem that the color of an image changes to a dark color or a light color between an initial stage of printing and a subsequent stage thereof.

Therefore, where a pigment ink is used conventionally, the ink is agitated to remove an unevenness in concentrations of pigment. Japanese Patent Laid-Open No. 2003-159813 has described that, as shown in FIG. 12, a spherical weight 15 which can move is accommodated inside an ink cartridge and the weight moves inside the cartridge in association with motions of the carriage, thereby agitating an ink. Further, Japanese Patent Laid-Open No. 2006-188008 has described a cartridge C in which an ink IN and air EA separated from the ink IN are filled in a state where the ink cartridge is not yet used as shown in Step (a) of FIG. 13. Since the air EA is filled in the cartridge C, in line with movement of the cartridge by the carriage shown in Step (b) to Step (f) of FIG. 13, the ink IN inside the cartridge is given mobility due to the presence of the air EA, thus making it possible to agitate the ink IN. Specifically, a space is formed by the thus filled air EA in the cartridge C, by which the ink IN is mobilized in association with the movement of the cartridge C. This mobility causes a rotational flow in the ink IN and the rotational flow agitates the ink IN.

However, as shown in the agitation constitution described in Japanese Patent Laid-Open No. 2003-159813, in a constitution in which a weight is used to agitate, there is a risk that a moving body may damage an inner wall of an ink cartridge on collision with the inner wall thereof. Further, there are problems that the ink cartridge for accommodating the moving body is made more complicated in structure and constituents for the ink cartridge including the moving body are additionally required leading to an increase in production costs.

The agitation constitution disclosed in Japanese Patent Laid-Open No. 2006-188008 is not made complicated in structure for an ink accommodation portion of an ink tank and also able to give a sufficient agitation effect to an accommodated ink, while suppressing an increase in production costs. However, since a gas is filled inside the ink accommodation portion even in a state where an ink tank is not yet used, the filled air may expand with an increase in external temperatures, by which pressure inside the sub tank may increase and the ink may leak outside the tank.

SUMMARY OF THE INVENTION

An object of the present invention is to provide an ink jet printing apparatus which is not complicated in structure or does not cause an increase in production costs but is able to obtain a sufficient agitation effect without causing disadvantage such as leakage of ink.

In a first aspect of the present invention, there is provided an ink jet printing apparatus that uses an ink tank storing ink and a printing head for ejecting ink supplied from the ink tank to perform printing, the apparatus comprising:

a supply-discharge unit for putting gas into and discharging gas inputted into the ink tank from the ink tank;

a moving unit for moving the ink tank in a reciprocating manner; and an agitation control unit for causing the supply-discharge unit to put gas into the ink tank, causing the moving unit to move the ink tank in the reciprocating manner, and then causing the supply-discharge unit to discharge gas from the ink tank into which the gas has been putted.

In a second aspect of the present invention, there is provided an ink jet printing apparatus that uses a printing head for ejecting ink and an ink tank in which pressure of ink stored is kept to negative pressure relative to pressure at an ejection portion of the printing head by that an ink chamber is expanded by means of elastic force of an elastic member, the apparatus comprising: a supply-discharge unit for putting gas into and discharging gas inputted into the ink tank from the ink tank; a moving unit for moving the ink tank in a reciprocating manner; and an agitation control unit for causing the supply-discharge unit to put gas into the ink tank, causing the moving unit to move the ink tank in the reciprocating manner, and then causing the supply-discharge unit to discharge gas from the ink tank into which the gas has been putted.

According to the above-described constitution, a gas is filled inside an ink tank, thus making it possible to form a gas in contact with an ink inside the ink tank. The ink is subjected to reciprocal movement, with this state kept, by which the gas mixed in the ink tank is used to agitate the ink. Thereafter, the gas inside the ink tank is discharged. The above-described agitation control allows the gas utilized in the agitation to discharge from the ink tank after agitating motions. Thereby, it is possible to prevent the gas from remaining inside the ink tank to expand, thereby adversely influencing the pressure relationship with a printing head.

As a result, it is possible to provide an ink jet printing apparatus which is not complicated in structure or does not cause an increase in production costs but is able to obtain a sufficient agitation effect without any disadvantage such as leakage of ink.

Further features of the present invention will become apparent from the following description of exemplary embodiments (with reference to the attached drawings).

DESCRIPTION OF THE EMBODIMENTS

Hereinafter, a detailed description will be given of the embodiments of the present invention with reference to the drawings.

First Embodiment

Figure 1:
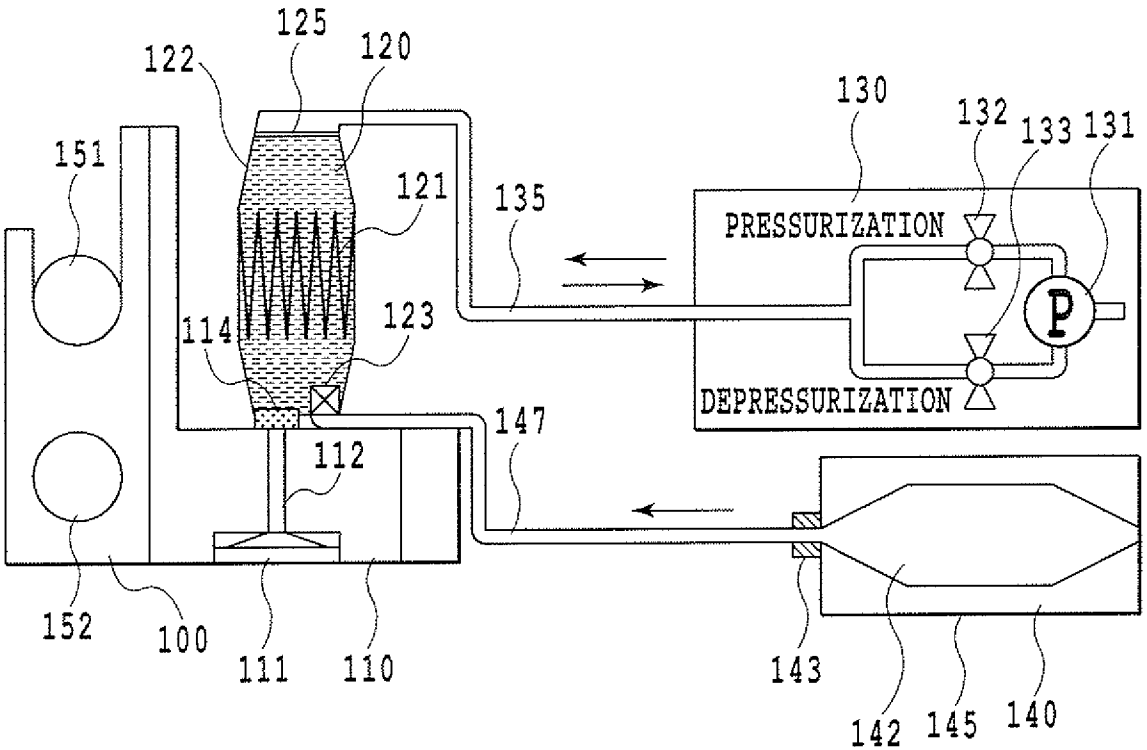
FIG. 1 is a view schematically showing mainly an ink supply system of the ink jet printing apparatus according to a first embodiment of the present invention.

FIG. 1 is a view schematically showing an ink supply system of the ink jet printing apparatus according to a first embodiment of the present invention.

In FIG. 1, reference numeral 110 denotes a printing head for ejecting an ink, and the printing head 110 is mounted on a carriage 100. Further, a sub tank 120 is attached to the carriage 100. Then, an ink is supplied from the sub tank 120 via a filter 114 to the printing head 110. The printing head 110 is provided with a nozzle 111 for ejecting the ink and an ink flow channel 112 for supplying the ink from the sub tank to the nozzle.

Reference numeral 140 denotes a main tank, and the main tank is constituted by including a tank joint 143 connecting to an ink supply tube, an ink bag 142 for storing an ink, and a main tank case 145 for accommodating the ink bag. The ink bag 142 supplies the ink to the sub tank 120 via the tank joint 143 and the ink supply tube 147. Upon supply of the ink to the sub tank, pressure is applied to the ink bag 142 by a mechanism (not illustrated) using a pump for pressurization, by which the ink is supplied.

Reference numeral 130 denotes a pump unit, and the pump unit is provided with an air pump 131, a pressurization side valve 132 and a depressurization side valve 133. The pump unit 130 is connected via an air supply tube 135 to a gas-liquid separation membrane 125 mounted on an air channel at the upper part of the sub tank 120. After the pressurization side valve or the depressurization side valve is turned on, the air pump 131 is driven, thus making it possible to supply compressed air or decompressed air to the gas-liquid separation membrane 125 of the sub tank 120.

The sub tank 120 is provided with a sub tank case 122, a sub tank spring 121 fixed inside the case, an ink supply limiting valve 123 and a gas-liquid separation membrane 125. Specifically, the sub tank case 122 is made of a flexible member and the spring 121 fixed inside thereof urges the case 122 in the direction at which the spring extends, thereby increasing the capacity of an ink reservoir inside the ink case to generate negative pressure lower than an atmospheric pressure. As a matter of course, the urging mechanism shall not be limited to the above-described spring form and any form will be acceptable as long as it is an elastic member capable of expanding the flexible member. The negative pressure inside the sub tank makes it possible to prevent leakage of the ink from a nozzle 111 which is an ejection portion of the printing head upon non-ejection of the ink. Further, when the ink is supplied to the sub tank at a predetermined quantity or more, the ink supply limiting valve 123 is closed depending on a relationship between the pressure resulting from pressurization to the ink bag 142 in the main tank 140 and the negative pressure inside the sub tank, thus stopping the ink flow. Thereby, it is possible to keep constant the quantity of the ink inside the sub tank and also keep the negative pressure inside the sub tank in such a certain range that the ink does not leak out upon non-ejection of the ink as described above and the ink is normally ejected upon ejection. Further, the gas-liquid separation membrane 125 allows a gas to pass through and prevents a liquid from passing through, thus making it possible to supply the air to the sub tank 120 and also discharge the air therefrom by the air pump unit 130. Specifically, the gas-liquid separation membrane 125 does not allow any of the ink and air to pass in a state that no pump is driven and no pressure difference greater than a certain level is developed. However, the gas-liquid separation membrane 125 allows only the air to pass through when the pump is driven to develop the pressure difference greater than the certain level. As described above, the air pump 130, the gas-liquid separation membrane 125 and others constitute a mechanism for supplying air to and discharging it from the sub tank.

Figure 2:
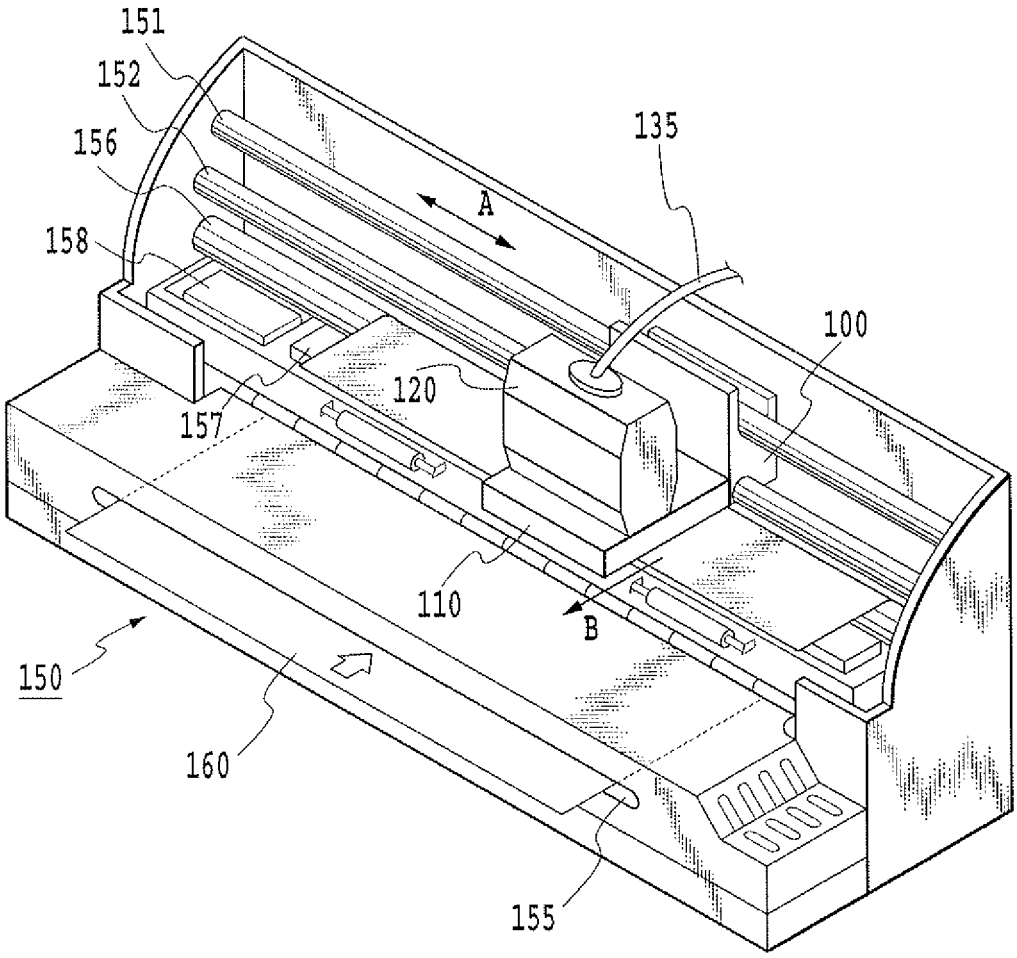
FIG. 2 is a perspective view showing a brief constitution of the ink jet printing apparatus shown in FIG. 1.

FIG. 2 is a perspective view showing briefly a constitution of an ink jet printing apparatus 150 equipped with the ink supply system shown in FIG. 1. As shown in FIG. 2, the carriage 100 is, as described above, provided with the printing head 110 and the sub tank 120. The carriage 100 is supported by shafts 151, 152 and able to move in a reciprocating manner in directions indicated by the arrow A. In a printing operation, a roller 156 is used to transfer printing sheet 160 on a platen 157 in a direction indicated by the arrow B. Therewith, the carriage 100 is moved in a reciprocating manner in the directions indicated by the arrow A, during which an ink is ejected on the printing sheet 160 from a nozzle 111 (FIG. 1) of the printing head 110, thereby printing an image. It is noted that the air pump unit 130 for the sub tank 120 and the main tank 140 are omitted from illustration in FIG. 2.

Hereinafter, a constitution of ink agitation in the sub tank according to a first embodiment of the present invention, in the above-constituted ink jet printing apparatus will be described.

Figure 3:
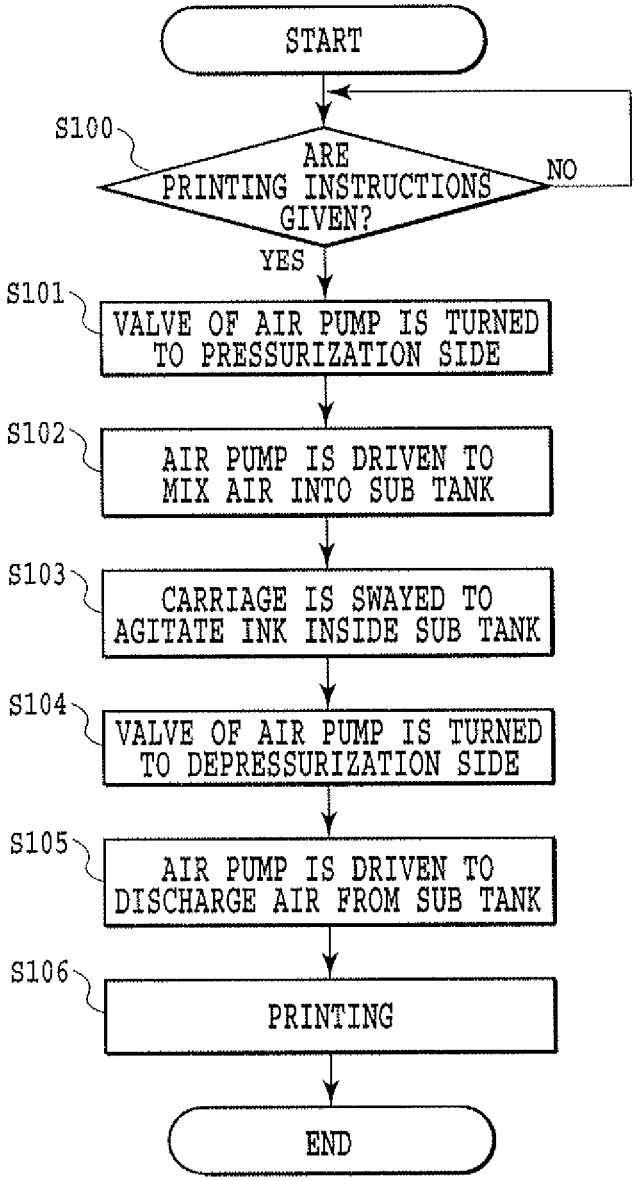
FIG. 3 is a flowchart showing agitation processing for an ink tank according to the first embodiment of the present invention.

FIG. 3 is a flowchart showing the processing of ink agitation of the present embodiment, and the processing is controlled by a control part in the printing apparatus shown in FIG. 2. Specifically, the control part is provided with a CPU, a RAM, a ROM and others, executing a program of the processing that is shown in FIG. 3 and is stored in the ROM, thereby controlling the ink agitation. In the present embodiment, the agitation is performed by setting an agitating mode which is performed prior to the execution of printing operation.

First, in Step 100, a determination is made whether any printing instructions are given to the ink jet printing apparatus. When the determination is made that the printing instructions are given, an agitating operation is performed in Steps 101 to 105. When no printing instructions are given, the instruction is waited.

Figure 4:
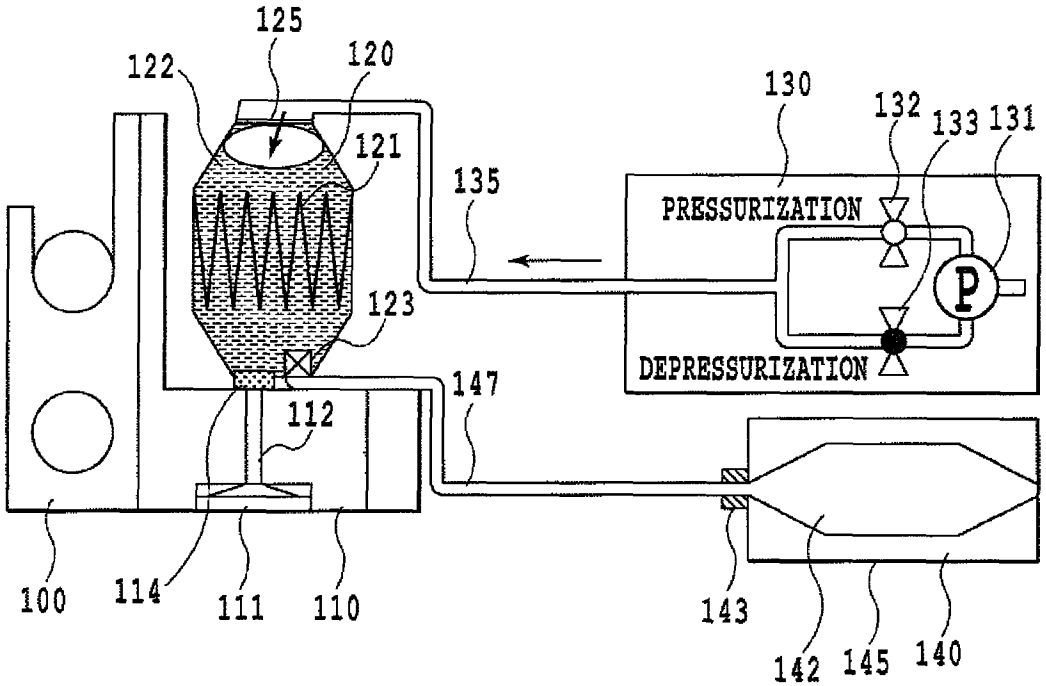
FIG. 4 is a schematic diagram for explaining air mixing motions in the agitation processing.

In Step 101, as shown in FIG. 4, the pressurization side valve 132 of the air pump unit 130 is kept opened. In this case, the depressurization side valve 133 is kept closed (in a state indicated by the black circle in FIG. 4). Then, in Step 102, the air pump 131 is driven to supply (put) air into the sub tank via an air supply tube. Thereby, the air is mixed in a certain quantity into the sub tank 120 via the gas-liquid separation membrane 125. The amount of air to be mixed is regulated so that it is not lower than negative pressure (an absolute value thereof) inside the sub tank 120 which is able to prevent the leakage of ink from a nozzle of the printing head, in other words, so that an amount of mixed air is not too much.

Figure 13:
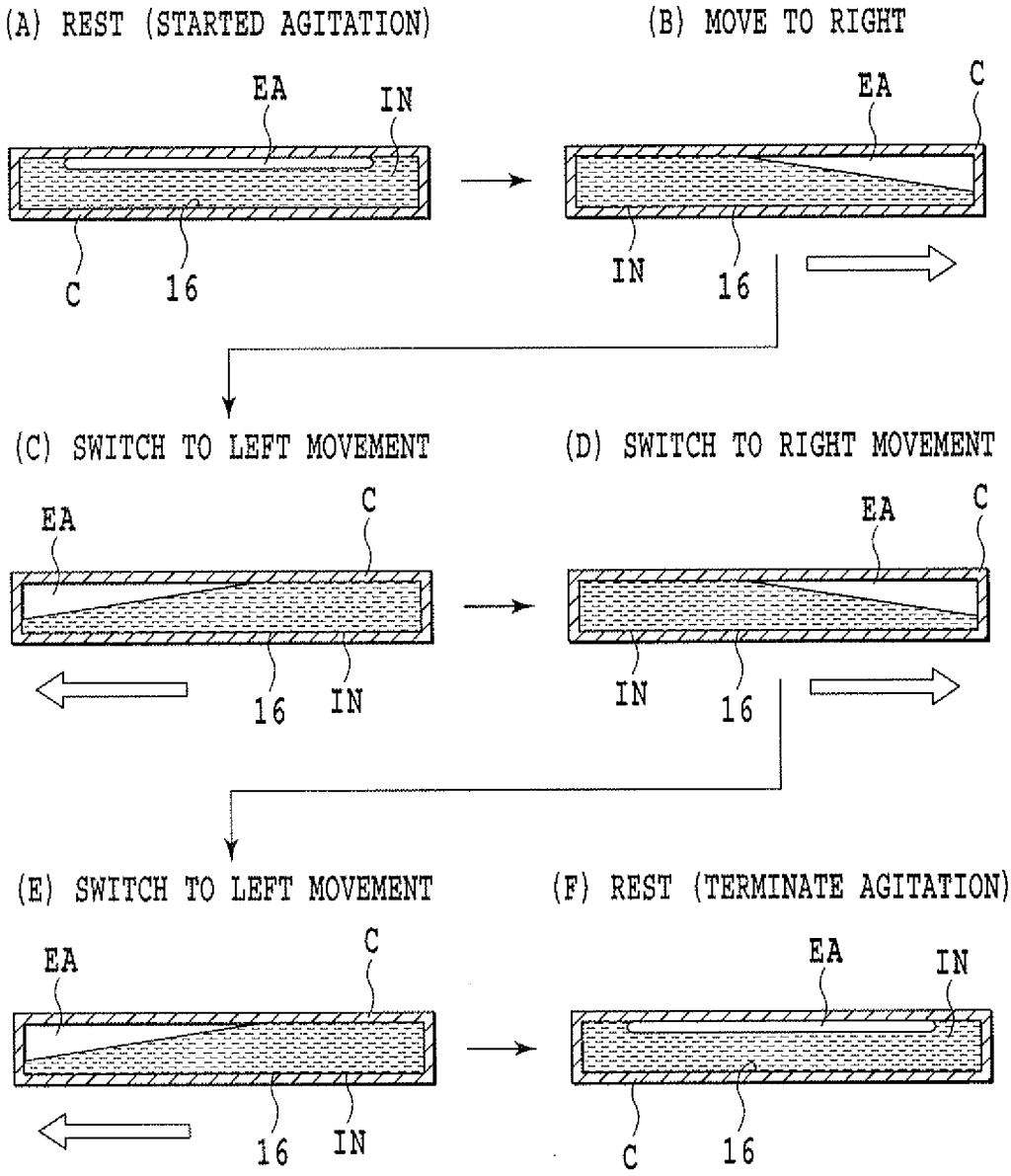
FIGS. 13 (A) via (F) are schematic diagrams for explaining ink agitating motions for an ink tank of another conventional example.

Next, in Step 103, as described in FIG. 13, the carriage 100 is swayed (moved in a reciprocating manner only in a predetermined range) and the air mixed inside the sub tank 120 is used to agitate an ink. In this agitation, the thus mixed air will not return to an air pump unit after passage via the gas-liquid separation membrane 125. Specifically, the gas-liquid separation membrane 125 is to prevent the passage of air excluding a case where a pressure difference equal to or higher than a predetermined level is generated by the air pump 131 when the air is mixed as described above and the air is discharged from a sub tank to be described later. Therefore, the air contained temporarily inside the sub tank is able to remain inside the sub tank and contribute to the above-described agitating operation until an operation for discharging the air are performed by the air pump in Step 105 to be described later.

Figure 5:
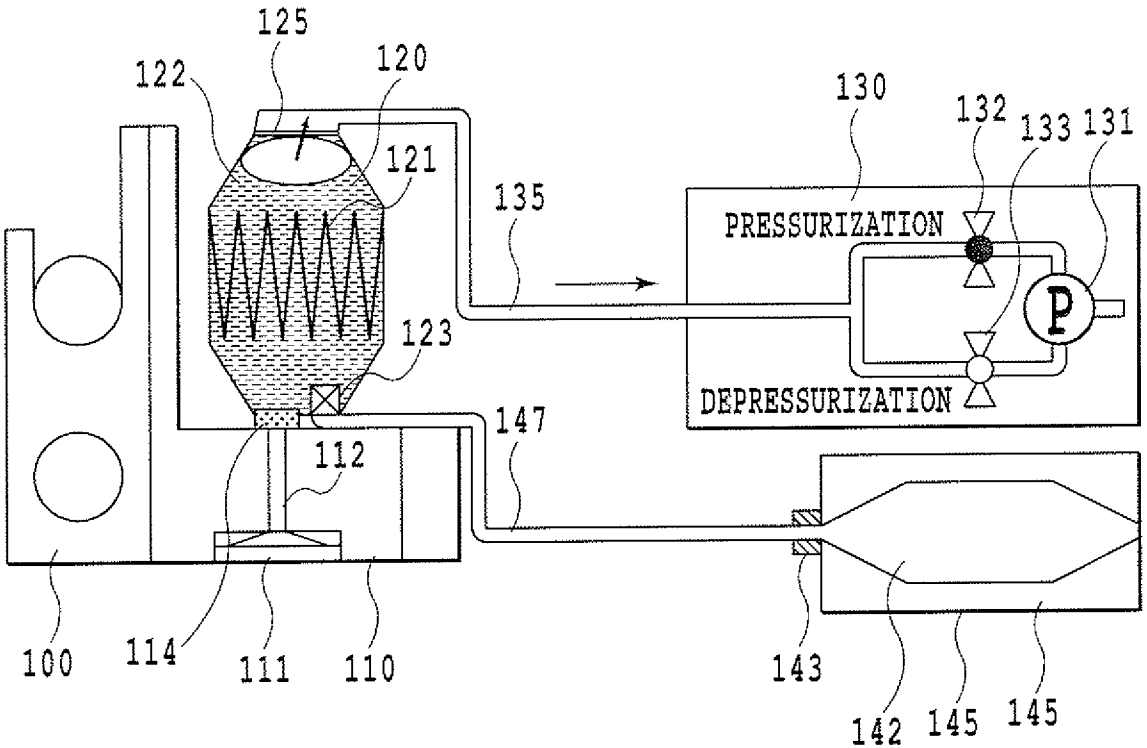
FIG. 5 is a schematic diagram for explaining air discharging motions in the agitation processing.

Further, in Step 104, as shown in FIG. 5, the pressurization side valve 132 of the air pump unit 130 is kept closed (in a state indicated by the black circle shown in FIG. 5), while the depressurization side valve 133 is kept opened. Then, in Step 105, the air pump 131 is driven to discharge the air inside the sub tank 120 via the gas-liquid separation membrane 125.

After completion of the above described agitating operation, a printing operation is performed in Step 106. In the printing operation, the ink is sufficiently agitated inside the sub tank 120 and air is kept discharged almost completely, by which stable printing operation is attained. Specifically, since air utilized for agitation is discharged from an ink tank after an agitation operation, a case that the air remains and expands inside the ink tank to exert an adverse influence on the pressure relationship with a printing head, can be prevented.

Second Embodiment

Figure 6:
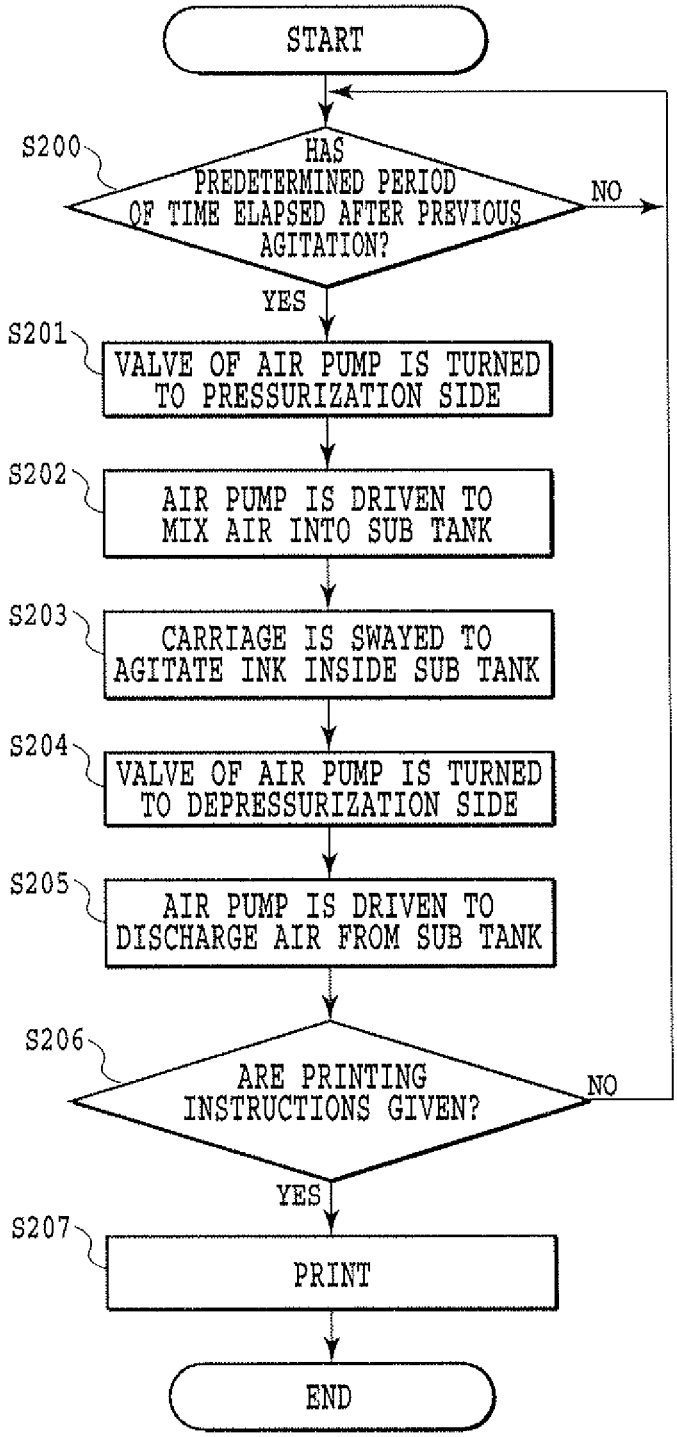
FIG. 6 is a flowchart showing the agitation processing for the ink tank according to a second embodiment of the present invention.

FIG. 6 is a flowchart showing the processing related to an agitating operation according to a second embodiment of the present invention. With ink in an ink tank, after the elapse of a predetermined period of time, settling of pigment ink may advance. Therefore, in the present embodiment, even when no printing instruction is given to an ink jet printing apparatus, the processing proceeds to an agitating mode. Specifically, in Step 200, a determination is made for whether the predetermined time has elapsed from the time of the last performed agitating operation. When a determination is made that the predetermined time has elapsed and the pigment ink is in a state of sedimentation, the agitating operation is performed in Steps 201 to 205. Since the agitating operation of the present embodiment is the same as that of the first embodiment, the description thereof will be omitted here. After completion of the agitating operation, a determination is made for whether any printing instruction is given in Step 206. Where no printing instruction is given, the processing returns to Step 200 and is kept on standby for the predetermined period of time. It is noted that criteria for the elapsed time can be set individually depending on the types of ink. For example, for pigment inks which easily settle, the elapsed time set shorter.

Third Embodiment

Figure 7:
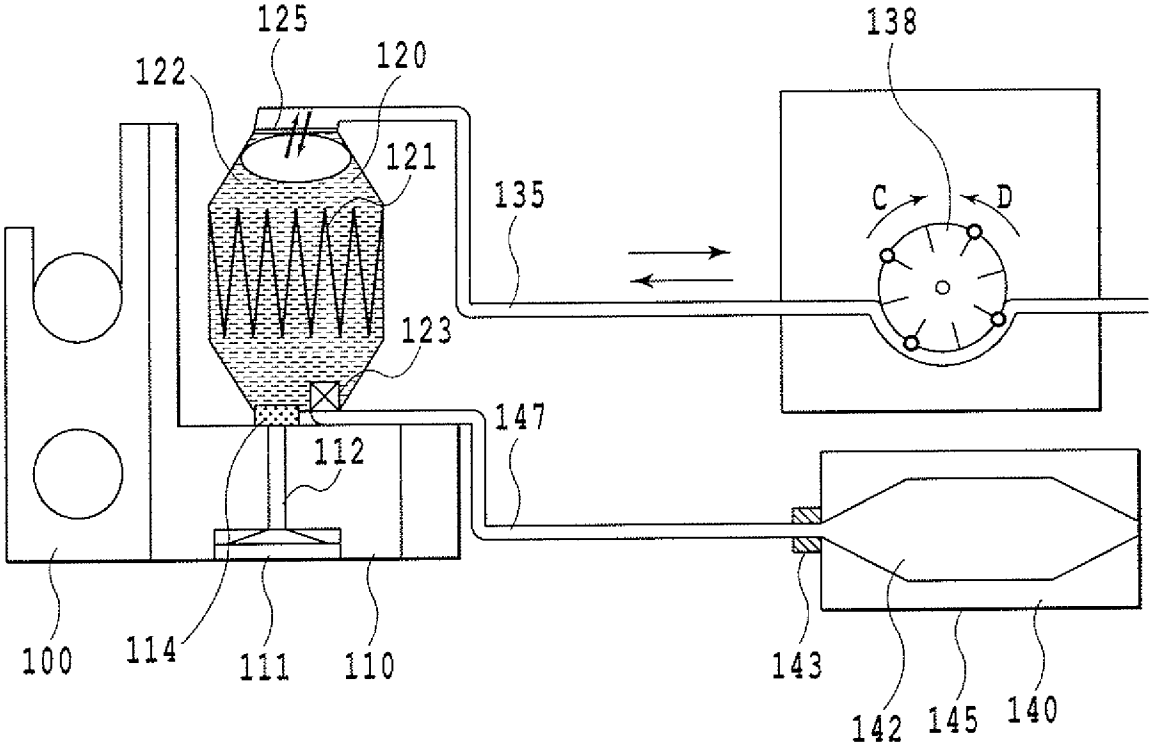
FIG. 7 is a view schematically showing mainly an ink supply system of the ink jet printing apparatus according to a third embodiment of the present invention.

FIG. 7 is a view schematically showing mainly an ink supply system of the ink jet printing apparatus according to a third embodiment of the present invention. As shown in FIG. 7, a tube pump is used as the pump in the present embodiment. Thereby, it is possible to eliminate the necessity for exchanging valves, unlike the air pump used in the above-described embodiment. Specifically, a rotating roller 138 is changed in rotating direction, thus making it possible to select the pressurization or the depressurization. In FIG. 7, the rotating roller 138 is allowed to rotate clockwise or in a direction indicated by the arrow C, by which air can be sent into the sub tank 120 via an air supply tube 135. On the other hand, when the rotating roller is allowed to rotate counterclockwise or in a direction indicated by the arrow D, air can be discharged from the sub tank 120 via the air supply tube 135.

Fourth Embodiment

Figure 8:
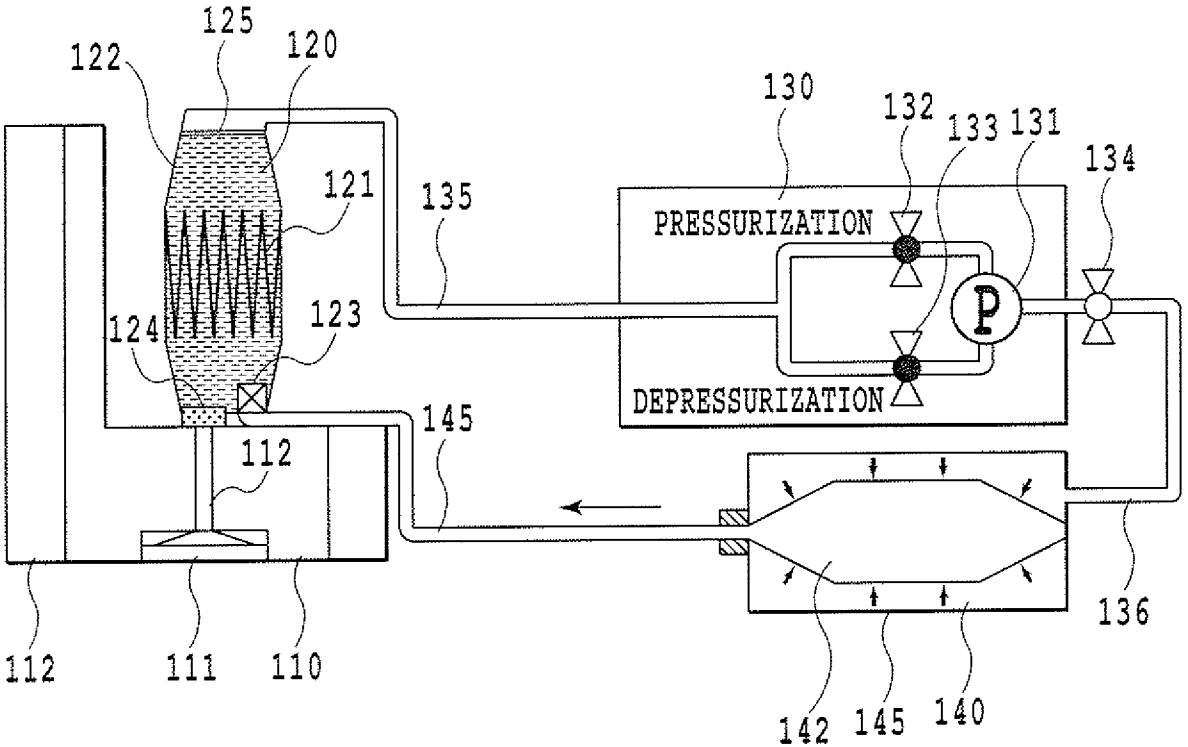
FIG. 8 is a view schematically showing mainly an ink supply system of the ink jet printing apparatus according to a fourth embodiment of the present invention.

FIG. 8 is a view schematically showing mainly an ink supply system of the ink jet printing apparatus according to a fourth embodiment of the present invention. As shown in FIG. 8, in the present embodiment, air is sent from an air pump unit 130 via a main tank air supply tube 136 to a main tank, thereby applying pressure on the main tank.

Specifically, a main tank case 145, which is a jacket of the main tank 140, is of an airtight structure. Then, a main tank pressurization side valve 134 of the air pump unit 130 is opened and the air pump 131 is driven, by which compressed air is supplied into the main tank 140 to apply a pressure to an ink bag 142. Thereby, it is possible to supply an ink efficiently to a sub tank without providing any separate compressing mechanism as described in the first embodiment to the third embodiment. As described above, it is possible to use one air pump as two functions, that is, to supply (put) and discharge air into and from the sub tank and to apply pressure for assisting the ink supply from the main tank to the sub tank.

Fifth Embodiment

Figure 9:
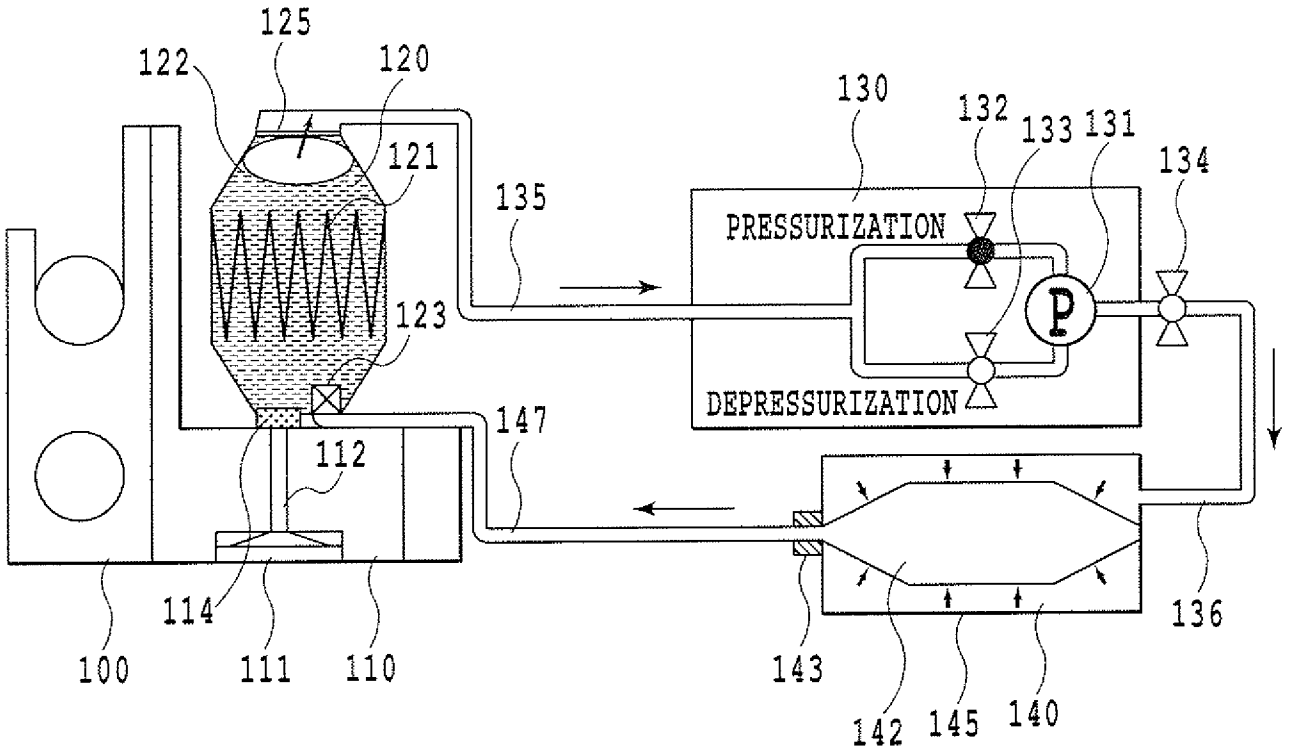
FIG. 9 is a view schematically showing mainly an ink supply system of the ink jet printing apparatus according to a fifth embodiment of the present invention.

FIG. 9 is a view schematically showing mainly an ink supply system of the ink jet printing apparatus according to a fifth embodiment of the present invention. The present embodiment is a modified example of the fourth embodiment.

Specifically, as shown in FIG. 9, when the air pump 131 is driven to send air for pressurization from the air pump unit 130 to the main tank 140, the depressurization side valve 133 is also kept opened. Thereby, it is possible to perform at the same time the operation of applying pressure on the ink bag 142 to supply an ink to the sub tank 120 and the operation of discharging air from the sub tank 120. As a result, it is possible to supply the ink more efficiently and more quickly into the sub tank 120.

Sixth Embodiment

Figure 10:
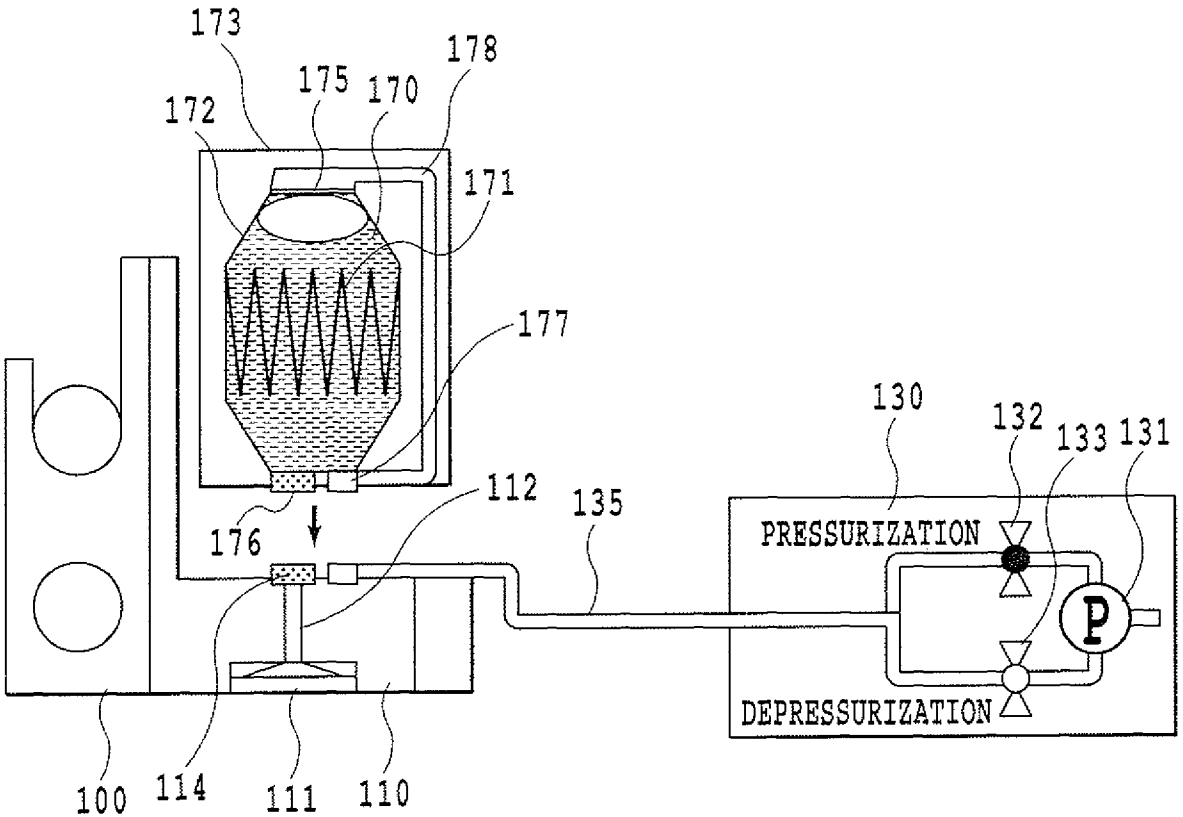
FIG. 10 is a view schematically showing mainly an ink supply system of the ink jet printing apparatus according to a sixth embodiment of the present invention.
Figure 11:
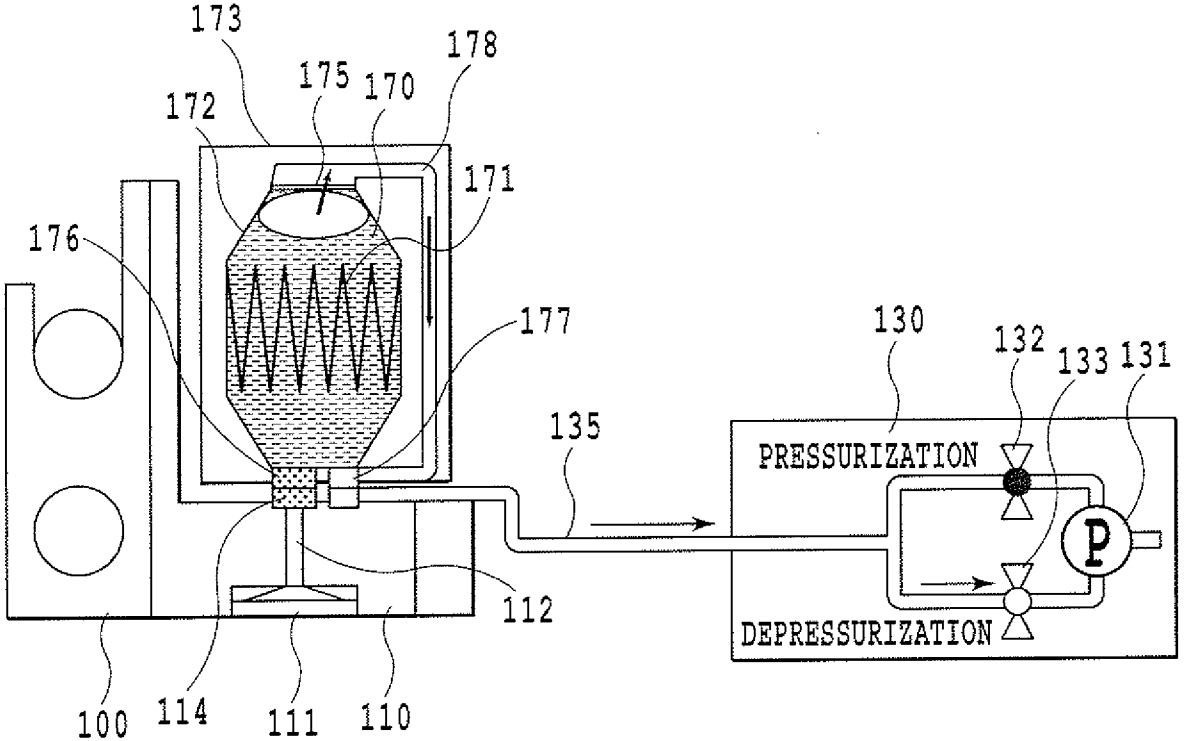
FIG. 11 is a schematic diagram for explaining air mixture and air discharging motions in the agitation processing according to the sixth embodiment of the present invention.
Figure 12:
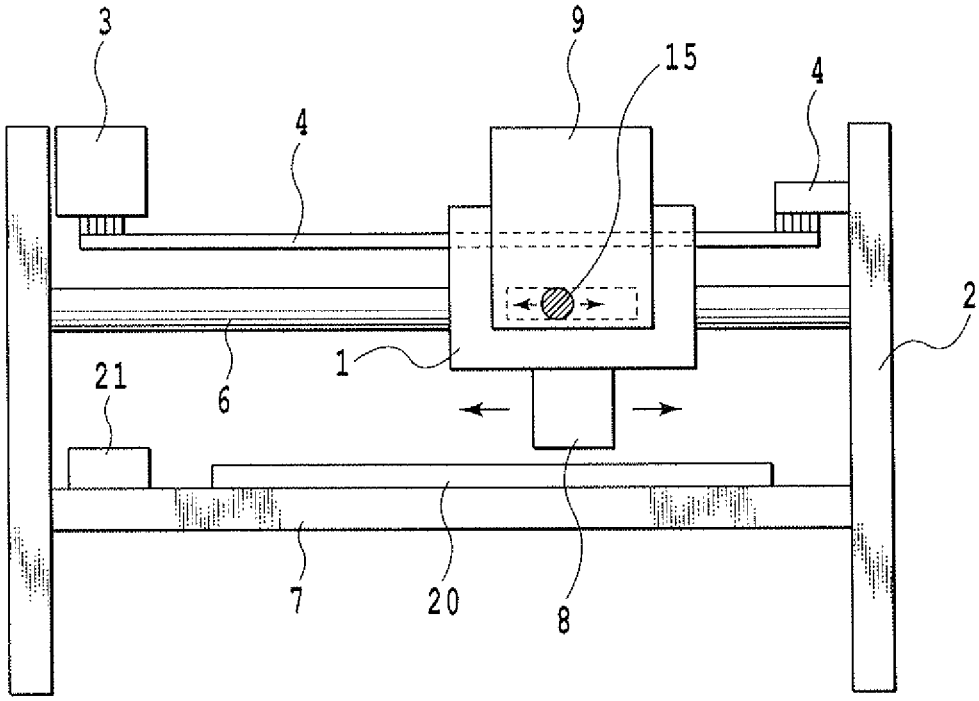
FIG. 12 is a schematic diagram for explaining ink agitating motions for an ink tank of one conventional example.

FIGS. 10 and 11 are views schematically showing mainly an ink supply system of the ink jet printing apparatus according to a sixth embodiment of the present invention. The present embodiment is different from the first embodiment to the fifth embodiment in that no main tank is provided but an ink tank is simply mounted on a carriage.

In FIGS. 10 and 11, reference numeral 170 denotes an ink tank, and the ink tank 170 is, as with each of the embodiments described above, provided with a tank spring 171, an ink bag 172, and a gas-liquid separation membrane 175. The present embodiment is additionally provided with a tank joint 176, an air joint 177 and an air flow channel 178.

As with the above-described embodiment, an elastic force of the tank spring 171 is utilized to keep the inside of the ink bag 172 which contains an ink to negative pressure. The tank joint 176 is, as shown in FIG. 11, connected to a filter 114 of a printing head 110, by which the ink can be supplied. On the other hand, the air joint 177 is normally kept closed and, as shown in FIG. 11, when the ink tank 170 is connected to the printing head 110, it is kept conductive to an air supply tube 135. Thereby, compressed air from the air pump unit 130 is guided via the air flow channel 178 to the gas-liquid separation membrane 175 and allowed to enter into the ink tank 170. Further, decompressed air by the air pump unit 130 can be guided via the air flow channel 178 into the gas-liquid separation membrane 175, by which air can be discharged from the ink tank 170.

The ink inside the ink tank is agitated, as described in each of the above embodiments, by procedures in which after air is introduced into an ink bag, the ink is agitated by reciprocating movement of the carriage 100 and air inside the ink bag is thereafter discharged.

Other Embodiment

As shown in the above-described sixth embodiment, the present invention is also applicable to a printing apparatus in which a main tank or a sub tank is not used as a constituent but only an ink tank mounted on a carriage is used. In this instance, the ink tank to be mounted may include a tank excluding that in which, as shown in the above-described sixth embodiment, the ink tank is expanded by a spring or the like to generate negative pressure. For example, the present invention is applicable to a case where in an ink tank having an atmosphere communicating hole and an absorber connected to a supply port portion with respect to a printing head to realize predetermined negative pressure with respect to the printing head, an ink is agitated which is stored inside an ink chamber at a part with no absorber. Specifically, the ink tank is provided with the air flow channel and the gas-liquid separation membrane as described in the sixth embodiment, thus making it possible to agitate by mixing air and subsequently to discharge the air.

Further, in each of the above-described embodiments, operations in which air is supplied to an ink tank, the air contained in the ink tank is used to agitate an ink and also the air is discharged from the ink tank are controlled by the gas-liquid separation membrane. However, the present invention shall not be applied only to the above embodiments but may also be applied to a case where in place of the gas-liquid separation membrane, for example, a valve is used to mix and discharge air by opening and closing the valve, thereby controlling each of the above operations. Further, in place of air, any gas reserved in a predetermined container other than air may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-110334, filed Apr. 21, 2008, which is hereby incorporated by reference herein in its entirety.

What is claimed is:

1. An ink jet printing apparatus comprising:
a printing head for ejecting pigment ink;
an ink tank storing pigment ink supplied to the print head;
a carriage for mounting the printing head and the ink tank;
a supply unit for supplying air to the ink tank;
a discharge unit for discharging air from the ink tank; and
a control unit for causing the carriage to be stopped and the supplying unit to supply air to the ink tank, then causing the carriage to move in a reciprocating manner for a plurality of times in a condition that air has been supplied to the ink tank by the supply unit, and thereafter causing the carriage to be stopped and the discharge unit to discharge air from the ink tank.

2. An ink jet printing apparatus as claimed in claim 1, wherein said ink tank is provided with a gas-liquid separation membrane which allows gas to pass through and prevents ink from passing through.

3. An ink jet printing apparatus as claimed in claim 1, wherein said supply unit is provided with a pump, and the pump supplies a pressurized air to the ink tank.

4. An ink jet printing apparatus as claimed in claim 1, wherein said discharge unit is provided with a pump, and the pump supplies air, the pressure of which is reduced, to the ink tank.

5. An ink jet printing apparatus as claimed in claim 1, wherein the supply unit and the discharge unit both include valves.

6. An ink jet printing apparatus as claimed in claim 1, further comprising a tube pump rotatable in first and second directions, and wherein when the tube pump is rotated in the first direction the air is supplied to the ink tank, and when the tube pump is rotated in the second direction the air is discharged from the ink tank.

7. An ink jet printing apparatus as claimed in claim 1, further comprising a main tank for storing ink to be supplied to the ink tank.

8. An ink jet printing apparatus as claimed in claim 7, wherein the supply unit is driven so that the ink is supplied from the main tank to the ink tank.

9. An ink agitating method in an ink jet printing apparatus that includes a printing head for ejecting pigment ink, an ink tank storing pigment ink supplied to the printing head, and a carriage for mounting the printing head and the ink tank, said method comprising:
a supplying step of supplying air to the ink tank with the carriage being stopped;

a moving step of moving the carriage in a reciprocating manner for a plurality of times after said supplying step and with air supplied in the supplying step; and a discharging step of discharging air from the ink tank after said moving step with the carriage being stopped.

* * * * *